US011522302B2

(12) United States Patent
Scherer et al.

(10) Patent No.: US 11,522,302 B2
(45) Date of Patent: Dec. 6, 2022

(54) CONNECTION OF A CONNECTION WIRE AND A CONNECTION ELEMENT

(71) Applicant: TDK Electronics AG, Munich (DE)

(72) Inventors: Wilfried Scherer, Rieden (DE); Herbert Lux, Heidenheim (DE); Balazs Nemeth, Szombathely (HU)

(73) Assignee: TDK ELECTRONICS AG, Munich (DE)

( * ) Notice: Subject to any disclaimer, the term of this patent is extended or adjusted under 35 U.S.C. 154(b) by 410 days.

(21) Appl. No.: 16/631,365

(22) PCT Filed: Aug. 3, 2018

(86) PCT No.: PCT/EP2018/071181
§ 371 (c)(1),
(2) Date: Jan. 15, 2020

(87) PCT Pub. No.: WO2019/025611
PCT Pub. Date: Feb. 7, 2019

(65) Prior Publication Data

US 2020/0220276 A1 Jul. 9, 2020

(30) Foreign Application Priority Data

Aug. 4, 2017 (DE) ..... 10 2017 117 748.5

(51) Int. Cl.

| | |
|---|---|
| ***H01R 4/14*** | (2006.01) |
| ***H01F 27/28*** | (2006.01) |
| ***H01F 27/29*** | (2006.01) |
| ***H01F 27/32*** | (2006.01) |
| ***H01R 4/02*** | (2006.01) |

(52) U.S. Cl.
CPC ..... *H01R 4/14* (2013.01); *H01F 27/2823* (2013.01); *H01F 27/29* (2013.01); *H01F 27/32* (2013.01); *H01R 4/023* (2013.01); *H01R 4/029* (2013.01)

(58) Field of Classification Search
CPC ..... H01R 4/14
USPC ..... 439/888
See application file for complete search history.

(56) References Cited

U.S. PATENT DOCUMENTS

| | | | | |
|---|---|---|---|---|
| 3,937,733 | A | 2/1976 | Ulbrich et al. | |
| 6,639,171 | B2 * | 10/2003 | Tsuge | H01F 41/10 219/56.22 |
| 2003/0010813 | A1 * | 1/2003 | Nakaya | B23K 3/087 228/41 |

FOREIGN PATENT DOCUMENTS

| | | | |
|---|---|---|---|
| CH | 540574 | A | 8/1973 |
| DE | 2508532 | A1 | 8/1976 |
| EP | 0651407 | A1 | 5/1995 |
| JP | S47039516 | A | 12/1972 |
| JP | S56093272 | A | 7/1981 |
| JP | S58008883 | U | 1/1983 |
| JP | 2014194861 | A | 10/2014 |
| WO | 2015011960 | A1 | 1/2015 |

* cited by examiner

*Primary Examiner* — Ross N Gushi
(74) *Attorney, Agent, or Firm* — Slater Matsil, LLP

(57) ABSTRACT

A connection of a connection wire and a connection element are disclosed. In an embodiment a connection includes a connection wire having an insulation and a stud-shaped metallic connection element, wherein the connection wire is wound in a plurality of turns around the connection element, and wherein the turns include a first wire section, in which the connection wire is insulation-stripped, and a second wire section, in which the insulation is present.

18 Claims, 1 Drawing Sheet

CONNECTION OF A CONNECTION WIRE AND A CONNECTION ELEMENT

This patent application is a national phase filing under section 371 of PCT/EP2018/071181, filed Aug. 3, 2018, which claims the priority of German patent application 102017117748.5, filed Aug. 4, 2017, each of which is incorporated herein by reference in its entirety.

TECHNICAL FIELD

The present invention relates to an electrical connection between a wire and a stud-shaped metallic connection element, e.g., between the winding wire of a coil and a connection pin.

BACKGROUND

In the formation of such an electrical connection, wire breaks can occur, specifically at the connection point. These are caused by tensile forces generated by mechanical or thermal action associated with an insulation-displacement/clamping connection or with a soldered or welded connection.

SUMMARY OF THE INVENTION

Embodiments prevent the above-mentioned disadvantages are, and provide the production of a reliable electrical connection. Moreover, specific requirements for resistance to cyclic temperature stress are fulfilled.

Embodiments of the invention are based upon a connection wire having an insulation, and a metallic stud-shaped connection element. The connection wire is wound in a plurality of turns around the connection element. The turns comprise a first wire section, in which the connection wire is insulation-stripped, and a second wire section, in which the connection wire is insulated. The winding of the connection wire about the connection element produces a large-area connection between the connection wire and the connection element. A large-area connection has a generally advantageous impact upon the stability of the connection. The winding incorporates an insulation-stripped wire section, which can be directly connected to the connection element by a welding or soldering method. Insulation stripping can be executed by a mechanical process such as, e.g., scrubbing/milling with a diamond-tipped tool, or by means of laser radiation.

In order to provide a sufficient large-area connection, both the insulated and the insulation-stripped section of the connection wire can each comprise one turn. The plurality of turns restricts the freedom of movement of the connection wire in a perpendicular direction to the connection element, and the insulation-stripped section constitutes a section with low-resistance contact, which can be directly connected to the connection element by a welding or soldering method.

In order to additionally maintain the stability of the connection parallel to the connection element, and in the interests of improved electrical contact, the connection can incorporate a soldering or welding point. The insulation-stripped wire section is thus soldered or welded to the connection element. The solder or weld metal forms a solid bond between the insulation-stripped wire section of the connection wire and the connection element.

The above-mentioned turns can be arranged in a row on the connection element. The turns can be divided into two groups: turns comprised of an insulated wire section and turns comprised of an insulation-stripped wire section. However, the length of the corresponding wire sections may not correspond exactly to a whole number multiple of a winding. A turn can also be comprised of two wire sections, in differing proportions.

In one advantageous embodiment, the turn of the insulated wire section is located at the end of the winding around the connection element at which the connection wire is fed in from the exterior, and thus, e.g., from an electrical component to the connection element. Accordingly, a first turn, after the connection wire has reached the connection element, is a constituent of the insulated wire section. As the insulated wire section is not soldered or welded to the connection element, a turn comprised thereof possesses a degree of flexibility. This is supported by a flexible or malleable insulation of the connection wire. By the incorporation of a flexible turn as a constituent of the connection, both thermal and mechanical strain, or tensile forces on the connection wire are compensated. The loading, e.g., of soldered components of the connection is reduced accordingly, and the overall stability of the connection is optimized.

The insulated wire section can comprise a second turn. This is positioned in the row of turns next to the first turn of the insulated wire section, and is thus also located at the end of the winding where the insulated connection wire is routed to its associated electrical component. By means of the second and, optionally, further turns which are constituted of the insulated wire section, even greater stability against thermal or mechanical strain, or against a tensile force on the connection wire or the connection, is provided.

The insulated section of the connection wire can be provided with a high-temperature-resistant insulation, which can be executed in the form of an enamel insulation. The "high-temperature-resistant" property is defined by the stability of insulation in response to heating up to 300° C. An insulation is also suitable which maintains its functionality at a temperature up to 400° C., or preferably up to 500° C. This high-temperature-resistant insulation also remains stable if the connection wire has been soldered or welded to the connection element. Any metallic connection between the connection wire and the connection element in the insulated wire section is excluded accordingly.

The conductor material of the connection wire can incorporate copper or aluminum, or can be comprised thereof. Both materials are economical, and simultaneously show a high electrical conductivity.

The insulation-stripped wire section can be located at the end of the connection wire. This means that, in such an embodiment, no wire section is present which, in the course of the connection wire from the electrical component to the connection element, follows the insulation stripped and optionally soldered or welded wire section.

One of the above-mentioned components can be an inductance, e.g., a coil. A coil of this type, having a connection to a connection element, is commonly employed in the automobile industry, or in sensor technology. However, the invention is not limited to these applications, but can rather be employed in all electrical components in which it is necessary to execute a connection of a connection wire to a connection element.

For the formation of the connection, it is advantageous if the connection wire, in the region of the turns, already incorporates a production-related tensile force, such as, e.g., the tensile force applied during the production of a coil.

BRIEF DESCRIPTION OF THE DRAWINGS

For the clarification of these arrangements.

FIG. 1 shows the connection of the connection wire and the connection element in a sectional view.

FIG. 2 shows the connection of the connection wire and the connection element in a perspective view.

DETAILED DESCRIPTION OF ILLUSTRATIVE EMBODIMENTS

Figure 1:
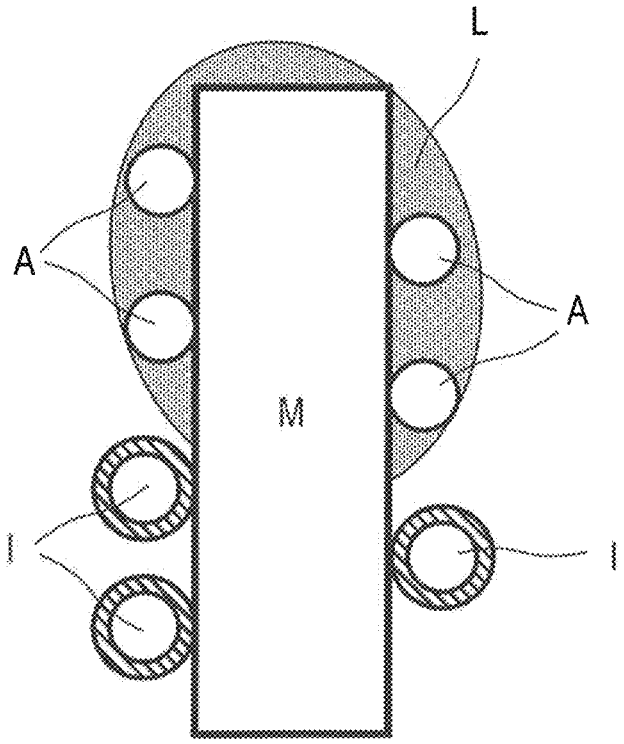
FIGS. 1 and 2 show schematic representations of the connection element with the connection wire and a soldered connection. These are exemplary embodiments, and describe the invention with reference to a functional segment, which is not true to scale.

FIG. 1 shows a sectional view of the connection of a connection wire A, I to a stud-shaped metallic connection element M. The connection wire, which comprises both insulated wire sections I and insulation-stripped wire sections A, is wound around the connection element M. In the figure, turns with the insulated wire section I at the lower end of the connection element M are represented. In order to obtain a reliable electrical connection, the turns of the insulation-stripped wire section A are soldered to the connection element M. During soldering, the solder L is distributed over the upper part of the connection element M, and thus covers all the turns of the insulation-stripped wire section A. The insulated wire section I, conversely, only lies in contact with the connection element, and is susceptible to deformation by any tensile forces arising. Such a tensile force can be generated by the cyclic temperature in the soldered joint. By means of the turns having an insulated wire section, the connection shows sufficient flexibility to accommodate thermal strain in the connection wire. Additionally, the insulation in the insulated wire section I possesses a degree of flexibility, and can also accommodate tensile forces, by means of a variation in cross-section.

Figure 2:
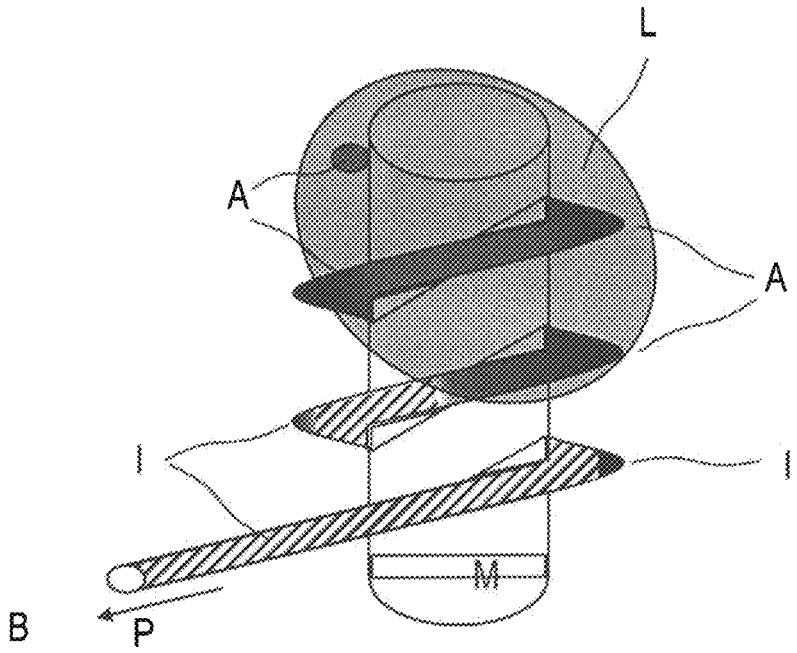

FIG. 2 illustrates the connection between the connection wire and the connection element M, in a perspective view. The connection wire respectively comprises a turn having an insulation-stripped wire section A and an insulated wire section I. The turn having the insulation-stripped wire section A is soldered to form a reliable connection with the connection element M. The solder covers all the turns in the insulation-stripped wire section A and the underlying connection element M. The turns of the insulated wire section I are not covered with the solder L The insulated wire section I, down-circuit of the final turn, leads to an electrical component B, which is located in the direction of the arrow P. Here, the connection wire is electrically connected to the component. The potentially arising tensile force is oriented parallel to the arrow direction P indicated.

The embodiment of the connection between the connection wire and the connection element is not limited to that represented in the figures, or to the embodiments otherwise described.

The invention claimed is:

1. A connection comprising:

a connection wire having an insulation;

a stud-shaped metallic connection element, wherein the connection wire is wound in a plurality of turns around the connection element, and wherein the turns comprise a first wire section, in which the connection wire is insulation-stripped, and a second wire section, in which the insulation is present; and a solder covering all turns in the first wire section, wherein the insulation is a high-temperature-resistant wire insulation, and wherein the high-temperature-resistant wire insulation remains stable when the connection wire is soldered or welded to the connection element.

2. The connection according to claim 1, wherein the first and the second wire sections each comprises one turn.

3. The connection according to claim 1, wherein the first wire section is soldered or welded to the connection element.

4. The connection according to claim 1, wherein the connection element is connected to an electrical component by the connection wire, wherein the turns are arranged in a row around the connection element, wherein one turn of the second wire section is arranged at an end of the row of turns at which the connection wire is routed out from the connection element to the electrical component.

5. The connection according to claim 4, wherein the electrical component is an inductance.

6. The connection according to claim 4, wherein the electrical component is a coil.

7. The connection according to claim 1, wherein the connection wire incorporates copper as a conductor material.

8. The connection according to claim 1, wherein the insulation-stripped wire section is located at one end of the connection wire.

9. The connection according to claim 1, wherein the connection wire incorporates aluminum as a conductor material.

10. A connection comprising:

a connection wire having an insulation;

a stud-shaped metallic connection element, wherein the connection wire is wound in a plurality of turns around the connection element, and wherein the turns comprise a first wire section, in which the connection wire is insulation-stripped, and a second wire section, in which the insulation is present; and a solder covering at least one full turn in the first wire section, wherein the insulation is a high-temperature-resistant wire insulation, and wherein the high-temperature-resistant wire insulation remains stable when the connection wire is soldered or welded to the connection element.

11. The connection according to claim 10, wherein the first and the second wire sections each comprises one turn.

12. The connection according to claim 10, wherein the first wire section is soldered or welded to the connection element.

13. The connection according to claim 10, wherein the connection element is connected to an electrical component by the connection wire, wherein the turns are arranged in a row around the connection element, wherein one turn of the second wire section is arranged at an end of the row of turns at which the connection wire is routed out from the connection element to the electrical component.

14. The connection according to claim 13, wherein the electrical component is an inductance.

15. The connection according to claim 13, wherein the electrical component is a coil.

16. The connection according to claim 10, wherein the connection wire incorporates copper as a conductor material.

17. The connection according to claim 10, wherein the insulation-stripped wire section is located at one end of the connection wire.

18. The connection according to claim 10, wherein the connection wire incorporates aluminum as a conductor material.

* * * * *